United States Patent [19]

Cade

[11] 4,395,224

[45] Jul. 26, 1983

[54] BURNER CONTROL SYSTEM

[75] Inventor: Phillip J. Cade, Winchester, Mass.

[73] Assignee: Electronics Corporation of America, Cambridge, Mass.

[21] Appl. No.: 190,243

[22] Filed: Sep. 24, 1980

Related U.S. Application Data

[63] Continuation-in-part of Ser. No. 9,307, Feb. 5, 1979, Pat. No. 4,243,372.

[51] Int. Cl.[3] ..... F23N 5/00

[52] U.S. Cl. ..... 431/31; 431/46; 431/79

[58] Field of Search ..... 431/29, 30, 31, 78, 431/79, 45, 46

[56] References Cited

U.S. PATENT DOCUMENTS

| | | | |
|---|---|---|---|
| 3,343,585 | 9/1967 | Eckelberry | 431/31 |
| 3,393,037 | 7/1968 | Giuffrida et al. | 431/31 |
| 3,449,055 | 6/1969 | Blackett | 431/31 |
| 3,644,074 | 2/1972 | Cade | 431/46 |
| 4,035,135 | 7/1977 | Jacobst | 431/29 |
| 4,137,035 | 1/1979 | Cade | 431/78 |
| 4,243,372 | 1/1981 | Cade | 431/31 |
| 4,249,884 | 2/1981 | Cade | 431/31 |

*Primary Examiner*—Daniel J. O'Connor
*Attorney, Agent, or Firm*—Charles E. Pfund

[57] ABSTRACT

A burner control apparatus for use with a fuel installation that has an operating control to produce a request for burner operation, a flame sensor to produce a signal when flame is present in the monitored combustion chamber, and one or more devices for control of ignition and/or fuel flow. The burner control apparatus comprises lockout apparatus for de-energizing the control apparatus, a control device for actuating the ignition and/or fuel control devices, and a timing circuit that provides four successive and partially overlapping timing intervals of precise relation, including a purge timing interval, a pilot ignition interval, and a main fuel ignition interval. The present invention further includes a burner control system which verifies the proper operation of certain sensors in a burner or furnace including particularly the air flow sensor. Additionally, the present system also prevents an attempt to ignite a burner if a condition is detected which indicates that the air flow sensor has been bypassed or wedged in the actuated position.

5 Claims, 9 Drawing Figures

LOSS OF AIRFLOW DURING FIRING CYCLE

FAILURE TO LIGHT PILOT

BURNER CONTROL SYSTEM

This application is a continuation-in-part of my application Ser. No. 9,307 filed Feb. 5, 1979, entitled Burner Control System, now U. S. Pat. No. 4,243,372.

FIELD OF THE INVENTION

This invention relates to electrical control circuits and more particularly to electrical control circuits adapted for us in burner control systems.

BACKGROUND OF THE INVENTION

Burner control systems are designed both to monitor the existence of flame in the supervised combustion chamber and to time and verify the sequence of operations of burner controls and safety interlocks. The safety of the burner operation is a prime consideration in the design of burner control systems. For example, if fuel is introduced into the combustion chamber and ignition does not take place within a reasonable time, an explosive concentration of fuel may accumulate. A burner control system should reliably monitor the existence of flame in the combustion chamber, accurately time a trial-for-ignition interval, inhibit ignition if a false flame signal is present, and shut down the burner in a safe condition whenever a potentially dangerous condition exists. Examples of such burner control systems are shown in U.S. Pat. No. 3,840,322 and U.S. application Ser. No. 769,307, filed on Feb. 16, 1977 by Philip J. Cade.

In burner control systems, different sensors are employed which provide electrical signals to the control system which indicate the presence or absence of various different conditions in the burner. Such sensors may malfunction and result in a dangerous condition occurring in the burner. Thus, a burner control system should verify the proper operation of such sensors. It also occasionally happens that a correctly operating burner is shut down by a burner control system due to a malfunctioning sensor or safety interlock. Upon investigation and discovery of the malfunctioning sensor or interlock, the sensor or interlock may sometimes be bypassed or artificially held in position so that the burner system may continue to be used until a replacement is obtained. Such bypassing of a sensor or interlock is extremely undesirable, because a dangerous condition may subsequently develop which the burner control system can no longer sense due to the bypassing of the inoperative device.

SUMMARY OF THE INVENTION

The present invention includes a burner control apparatus for use with a fuel burner installation that has an operating control to produce a request for burner operation, a flame sensor to produce a signal when flame is present in the monitored combustion chamber, and one or more devices for control of ignition and/or fuel flow. The burner control apparatus comprises lockout apparatus for de-energizing the control apparatus, a control device for actuating the ignition and/or fuel control devices, and a timing circuit that provides four successive and partially overlapping timing intervals of precise relation. As disclosed in the preferred embodiment two capacitors are employed for the timing intervals which are a function of the charging and discharging of the respective capacitors. An ignition sequence is commenced in response to a request for burner operation by actuating the timing circuitry and that timing circuitry energizes the control device at the end of the first or purge timing interval followed by a pilot ignition interval. The pilot ignition timing interval is followed by a pilot stabilization interval during which the flame should be maintained in the supervised combustion chamber. Following pilot flame stabilization, the main fuel ignition interval establishes the main flame in the combustion chamber. If flame is established during this interval, the flame signal responsive circuitry maintains the control device energized. If flame is not established during this timing interval, the lockout apparatus operates to de-energize the control apparatus.

The present invention further includes a burner control system which verifies the proper operation of certain sensors in a burner or furnace including particularly the air flow sensor. In order for the burner control system to initiate the main flame, the air flow sensor must go from a non-actuated to an actuated state at the proper time in the start-up sequence, indicating that the sensor is operating properly. Additionally, the present system also prevents an attempt to ignite a burner if a condition is detected which indicates that the air flow sensor has been bypassed or wedged in the actuated position. Thus, the present invention, in addition to preventing operation of the burner in response to a malfunctioning sensor, also prevents operation of the burner if the sensor has been tampered with.

A preferred embodiment of the present invention is disclosed in which the above described features are implemented by means of solid state circuitry which is compact and reliable and provides the desired operating characteristics.

BRIEF DESCRIPTION OF THE DRAWINGS

The operation and advantages of the present invention will become more clear upon reading the following description of the preferred embodiment in conjunction with the accompanying drawings, of which.

DESCRIPTION OF THE PREFERRED EMBODIMENT

Figure 1:
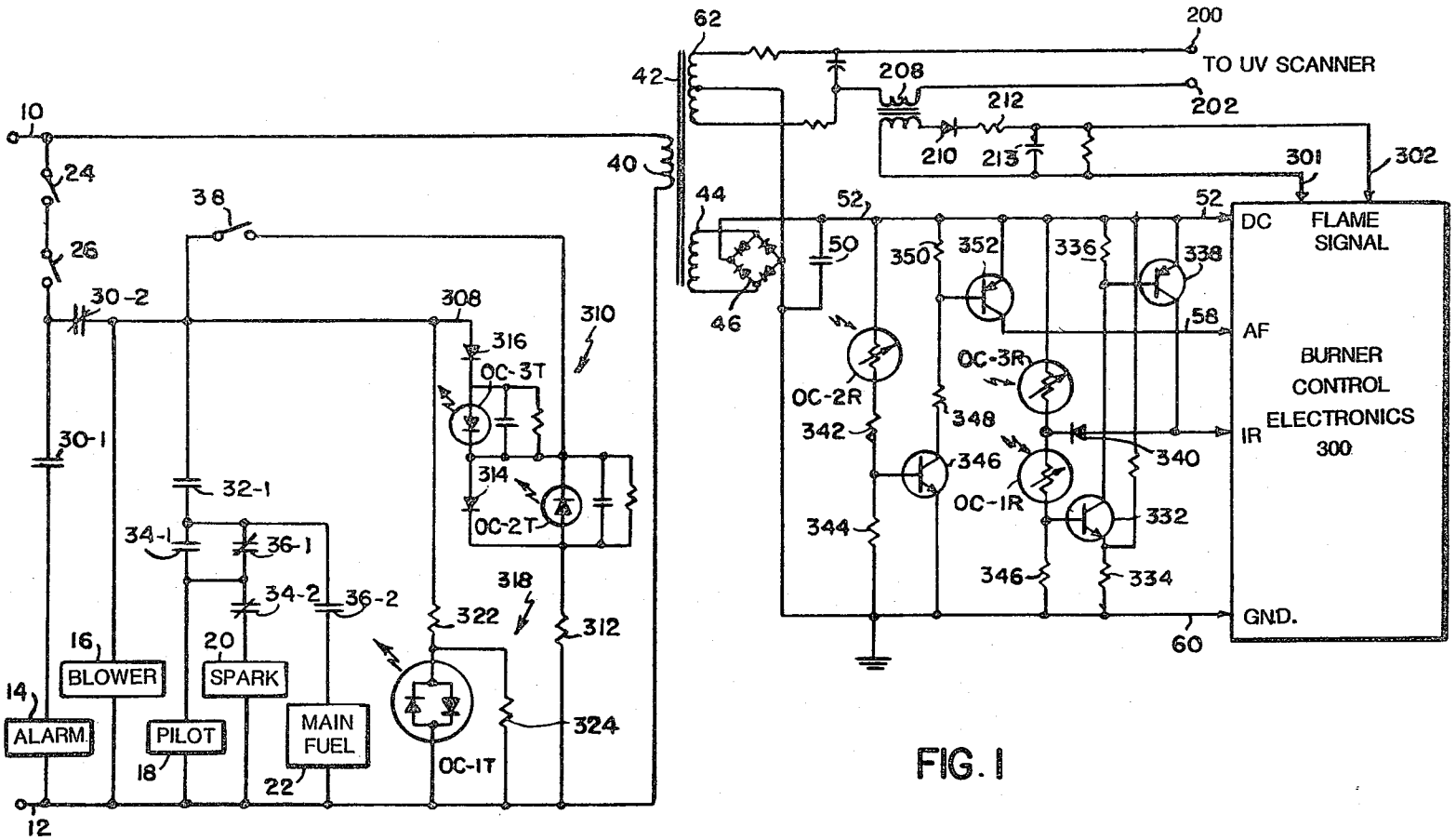
FIG. 1 shows a preferred embodiment of the present invention as it would be used in a burner control system.

With reference to FIG. 1, the illustrated burner control arrangement includes terminals 10, 12 adapted to be connected to a suitable source of power, a typical source being, for example, a 240-volt, 50 Hz source. Connected to those terminals is a control section that includes alarm device 14, blower 16, pilot fuel control 18, spark ignition control 20, and main fuel control 22. Limit switch 24 and operating control 26, such as a thermostat, are connected in series to terminal 10. Normally-open lockout contacts 30-1 are connected in series with alarm device 14 and normally-closed lockout contacts 30-2 are connected in series between operating control 26 and the other devices of the control section. Normally-open control relay contacts 32-1 control the application of power to the ignition and fuel controls 18, 20 and 22 via further contacts; normally-open pilot relay contacts 34-1 are connected in series with pilot fuel control 18; in series with normally-closed flame relay contacts 36-1 which are connected in series with the pilot fuel control 18 and through normally-closed pilot relay contacts 34-2 to ignition control 20; and normally-open flame relay contacts 36-2 are connected in series with main fuel control 22. An air flow switch 38 is normally open; and in response to air being circulated through the burner by blower 16, air flow switch 38 closes to provide a positive indication of air flow.

A first secondary winding 44 of a transformer 42 has a full wave rectifier 46 connected across its terminals to provide DC power for the electronics section, that power being applied to main bus 52. The primary winding 40 of transformer 42 is connected directly to terminals, 10, 12 so that bus 52 is continuously energized. A second secondary winding 62 of that transformer supplies power to terminals 200, 202 to which a flame sensor of the UV type is connected. The flame signal pulses are coupled by transformer 208 and a rectifier circuit that includes diode 210 to lines 301 and 302 which apply the flame signal to burner control electronics 300.

The limit switch 24 is normally closed, and lockout control is normally not actuated so that lockout contacts 30-2 are closed. When operating switch 26 closes, AC power is applied to a bus 308 from which several circuits described below are powered. Air flow switch 38 is connected in series between bus 308 and an optical coupler interlock circuit 310. When air flow switch 38 is closed by air from blower 16, power is applied to the optical coupler circuit 310. Optical coupler circuit 310 includes an optical coupler transmitter OC-2T connected in series with switch 38 and a current limiting resistor 312. A diode 314 is connected in parallel with transmitter OC-2T but with the opposite polarity. A second optical coupler transmitter OC-3T in series with a diode 316 connects bus 308 to the junction of switch 38 and optical coupler OC-2T. The RC circuits connected in parallel with the optical couplers serve to suppress any power line transients which may be applied to the optical couplers.

A second optical coupler circuit 318 is connected between bus 308 and terminal 12, and circuit 318 includes a current limiting resistor 320 connected in series with parallel-connected resistor 322 and optical coupler transmitter OC-1T.

Power is supplied to the burner control electronics 300 by three different lines: a DC line 52, an air flow line 58, and an ignition request line 330. As long as AC power is present at terminals 10 and 12, a steady source of DC power is applied from bus 52 to burner control electronics via line 326. The optical coupler receivers OC-1R, OC-2R, and OC-3R control the application of power to lines 58 and 330, as described below, to ensure safe operation of the burner.

When receivers OC-1R and OC-3R are both illuminated, power is applied via the two optical coupler receivers from line 52 to the base electrode of a transistor 332, causing transistor 332 to conduct. If either receiver OC-1R or OC-3R is not illuminated, transistor 332 will not turn on. The emitter of transistor 332 is connected to ground via a current limiting resistor 334, and the collector of transistor 332 is connected to power line 52 via load resistor 336. The collector of transistor 332 is connected to the base of transistor 338. The emitter of transistor 338 is connected to power bus 52, and the collector is connected to ignition request line 330 to burner control electronics 300, and transistor 338 applies power to ignition request line 330 when transistor 332 is turned on. The collector of transistor 338 is also applied via a diode 340 to the junction of receivers OC-1R and OC-3R.

Optical coupler receiver OC-2R is connected between power bus 52 and ground in series with resistors 342 and 344. The junction of resistors 342 and 344 is connected to the base electrode of a transistor 346. The emitter of transistor 346 is connected to ground, and the collector is connected via load resistors 348 and 350 to power bus 52. The junction of load resistors 348 and 350 is connected to the base electrode of a second transistor 352; and the emitter and collector electrodes of transistor 352 are connected between power bus 52 and air flow line 58 to burner control electronics 300. Transistor 352 applies power to air flow line 58 when transistor 346 is turned on. Transistor 346 is controlled by receiver OC-2R. When optical coupler OC-2R is not illuminated, the base of transistor 346 is held at ground potential by resistor 344, and no power is applied to air flow line 328. When optical coupler OC-2R is illuminated, transistor 346 turns on applying power to air flow line 328.

In operation, limit switch 24 is normally closed, and in response to a call for burner operation, switch 26 closes and power is applied to the control section. Blower 16 is then energized through normally closed lockout contacts 30-2. Power is also applied to optical coupler transmitter OC-1T through resistor 322.

The motor of blower 16 requires a short period of time to come up to speed and force air through the burner. Thus, immediately following the closure of contacts 26 and application of power to blower motor 16, air flow switch 38 should be in the open position indicating no air flow through the burner. If air flow switch 38 is closed at this time, this may indicate a defective air flow switch 38 or that someone has tampered with the air flow switch. In such a case, optical coupler circuit 310 prevents an ignition request signal from being applied to burner control electronics 300. This is done in the following manner.

As described above, optical coupler receivers OC-1R and OC-3R must both be illuminated in order for ignition request power to be applied on line 330 to burner control electronics 300. When switch 26 closes, applying power to blower motor 16, power is also applied through resistor 322 to optical coupler transmitter OC-1T illuminating the associated receiver OC-1R. When air flow switch 38 is open, power also flows from bus 308 through diode 316 to optical coupler transmitter OC-3T and thence through diode 314 and resistor 312 to common terminal 12. This current flowing through transmitter OC-3T illuminates the associated receiver OC-3R. Thus, if switch 38 is open when power is initially applied to the blower, both receivers OC-1R and OC-3R are illuminated and power is applied to ignition request line 330.

When air flow switch 38 is closed or bypassed at the time that switch 26 closes, diode 316 and optical coupler transmitter OC-3T are shunted by a short circuit. In this case, there is no voltage drop across transmitter OC-3T; and the corresponding receiver OC-3R is not illuminated, preventing transistors 332 and 338 from turning on so that no power is applied to ignition request line 330.

As the blower motor attains speed and air flow begins, air flow switch 38 closes and optical coupler receiver OC-3R turns off. However, once transistors 332 and 338 have turned on, power is applied from line 330 via diode 340 to optical coupler receiver OC-1R; and this feedback connection maintains transistors 332 and 338 in the "on" state until switch 38 opens turning off OC-1T and OC-1R.

Optical coupler OC-2T is not illuminated when switch 38 is open. The polarity of the diode in OC-2T is opposite that of diode 316 in series with OC-3T, and current flowing through OC-3T will not flow through OC-2T, flowing instead through diode 314. When air flow switch 38 closes, power is applied through switch 38 to optical coupler transmitter OC-2T, illuminating the corresponding receiver OC-2R. When receiver OC-2R is conducting, transistors 346 and 352 are turned on applying power on air flow line 58 to burner control electronics 300. If at any time the aire flow through the burner is reduced below the level needed to actuate air flow switch 38, switch 38 opens and optical coupler transmitter OC-2T turns off. This causes receiver OC-2R to switch to the non-conductive state, turning off transistors 346 and 352 and removing the air flow signal from line 328. In response to the loss of an air flow signal on line 328, the burner control electronics shut down the operation of the burner as described in more detail below.

Figure 2:
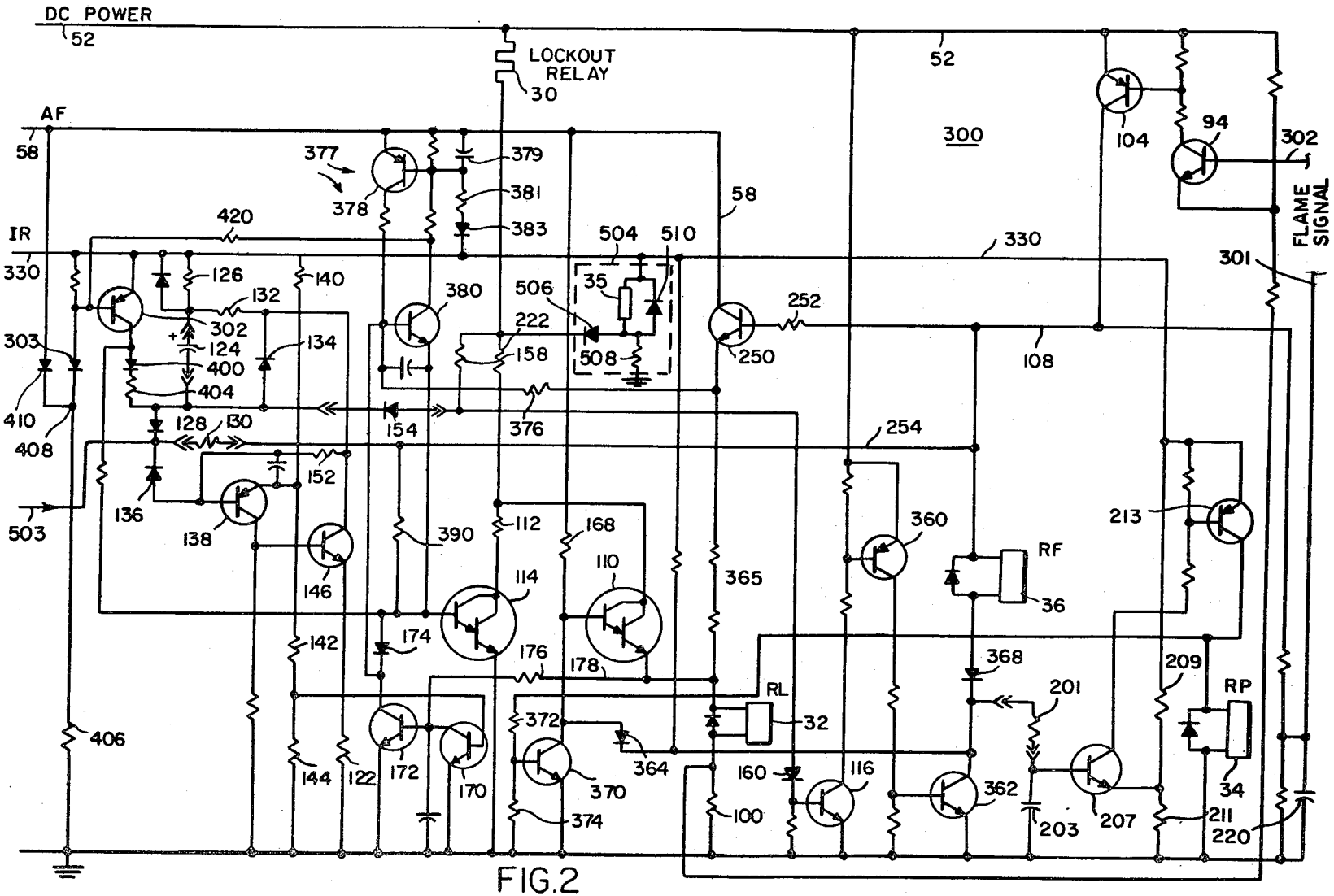
FIG. 2 is a detailed schematic diagram of the burner control electronics shown in FIG. 1.

The burner control electronics 300 are shown in more detail in FIG. 2. A lockout timing circuit connected to bus 52 includes a thermally responsive lockout actuator 30 which is energized through two alternate actuating circuits, the first circuit comprising a first actuating circuit through a resistor 222, Darlington pair 110 control relay coil 32 and resistor 100 to ground bus 60 and a second actuating circuit through resistors 222 and 112 and Darlington pair 114 to ground bus 60. The control electrode of Darlington pair 110 is connected to transistor 362 via diode 364 while the control electrode of Darlington pair 114 is connected to flame signal bus 108 by resistor 39 and to ground via diode 174 and transistor 172.

Connected to ignition request line 330 is a timing circuit that includes tantalum timing capacitor 124 whose positive terminal is connected to bus 58 through resistor 126 and whose negative terminal is connected to a bus 254 through diode 128 and resistor 130. Connected across timing capacitor 124 are resistor 132 and diode 134. Connected to the junction between diode 128 and resistor 130 via diode 136 is the base of transistor 138. The collector of transistor 146 is connected to the junction of resistor 132 and diode 134.

Connected between the negative terminal of timing capacitor 124 and lockout actuator 30 is a network of diode 154 and resistor 158. A diode 160 connects the junction of diode 154 and resistor 158 to the base of transistor 116 which is returned to ground via resistor 162. Darlington pair 110 is triggered into conduction by the turn off of transistor 116 via transistors 360 and 362. Diode 134 protects capacitor 124 from the application of reverse voltage.

The circuit for control of Darlington pair 114 includes transistors 170, 172, the collector of transistor 172 being connected via diode 174 to the base control electrode of Darlington pair 114. Darlington pair 114 is triggered into conduction in response to a flame signal on bus 108 applied through resistor 390 or conduction of transistor 146 unless its control electrode is clamped to ground via diode 174 and transistor 172 in conduction. The base of transistor 172 is connected by resistor 176 to line 178.

Timing capacitor 124, diode 154, and resistors 130 and 201 are mounted on a plug-in timing card and enable the pre-ignition interval T1 and trial-for-ignition interval T2+T3 to be readily changed as desired by substitution of different cards.

A second RC timing network includes resistor 201 and capacitor 203, the junction of which is coupled via diode 205 to the base of a transistor 207. The emitter of transistor 207 is biased at a fixed level by a voltage divider consisting of resistors 209, 211 and the collector of transistor 207 drives the base of a transistor 213. The transistor 213 when conducting energizes relay coil 34 which is connected in series from flame line 108 to ground 60 via the collector emitter path of transistor 213. The energized state of relay coil 34 is thus controlled by conduction in transistor 213 which in turn is determined by the voltage charge level of capacitor 203.

The burner control electronics 300 time two successive intervals based on charge and discharge of capacitor 124, a first blower (pre-ignition) interval T1 in which capacitor 124 is charged and a second pilot ignition and stabilization (ignition) interval T2+T3 in which the capacitor 124 is discharged. The timing of intervals T2 and T3 will be described later. As capacitor 124 charges, the voltage at the junction between diodes 128 and 136 drops towards the voltage on ground bus 60, controlling the first (pre-ignition) time delay interval T1 as a function of the RC values in that capacitor charging circuit (through resistor 130, relay coils 36). When the voltage at that junction has dropped sufficiently the interval T1 is ended by transistor 138 turning on, the resulting current flow turning on transistor 146 and a signal is fed back through resistor 152 to maintain (latch) transistor 138 in conducting condition. Conduction of transistor 146 abruptly drops the voltage on the plus side of capacitor 124 due to the voltage drop across resistors 126 and 132. This voltage transition is coupled through capacitor 124 and by diodes 154 and 160 applied to turn off transistor 116 and to turn on Darlington pair 110. As a result, current flows through a low resistance path of lockout actuator 30, resistor 100 to ground 60. Relay 32 is thus pulled in, closing contacts 32-1 and energizing pilot fuel control 18 and ignition control 20, establishing an ignition condition in the supervised combustion chamber. This corresponds to the start of pilot ignition interval T2. Transistor 170 is turned off by conduction of transistors 138, 146 and the signal on line 178 is coupled by resistor 176 to turn transistor 172 on, clamping the control electrode of Darlington pair 114 to ground and thus holding lockout actuator alternate energizing path through Darlington 114 non-conductive. The voltage rise at the junction of resistor 100 and relay coil 32 compensates for the voltage drop on supply bus 52 which occurs when the low resistance path through Darlington pair 110 is conductive so that there is no marked change in the reference voltage at the emitter of transistor 94 and thus stabilizes the response of the flame sensing circuit to signals at terminal 200.

Figure 3:
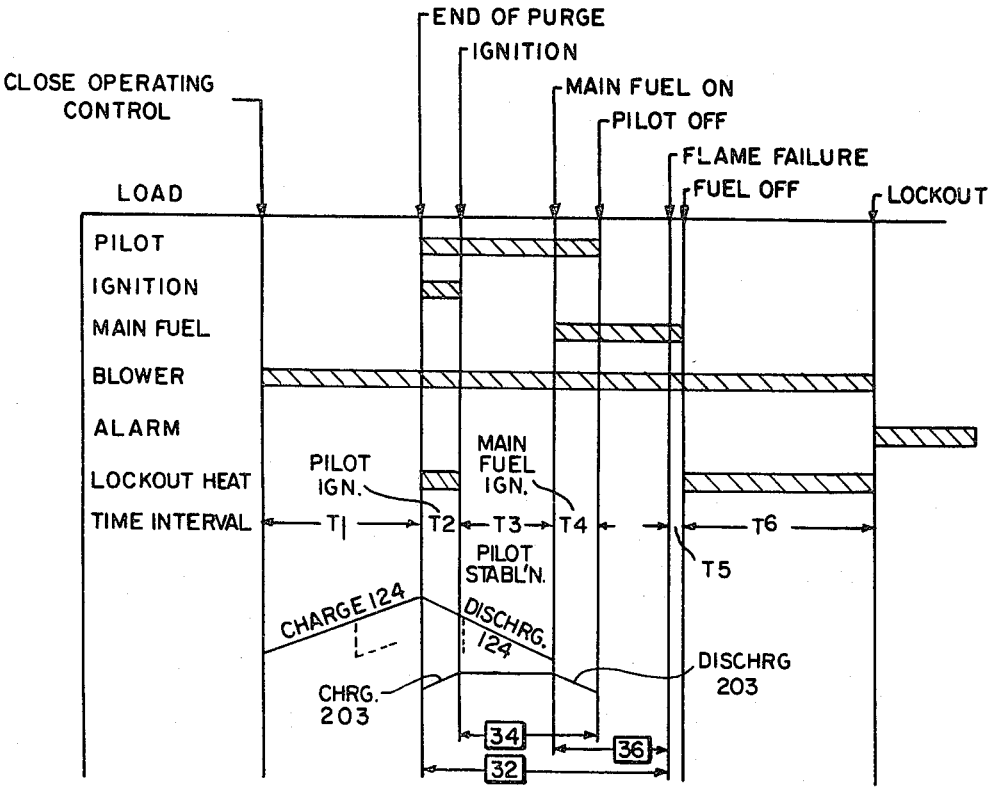
FIGS. 3–8 show the sequence of operations of the invention.

The timing intervals for the circuit of FIG. 1 will now be explained referring to FIG. 3 for aid in description. Upon call for heat closing switch 26 to energize blower 16, the air flow switch 38 is closed in response to purge air thereby applying power to air flow line 58 and ignition request line 330, as described above, in connection with FIG. 3; and capacitor 12 begins to charge. The charging time for capacitor 124 establishes the purge or pre-ignition interval T1 as previously described. Pre-ignition interval T1 ends at the start of pilot ignition timing interval T2 where capacitor 124 discharges at a rate determined essentially by the value of capacitor 124 and resistor 158 and establishes the interval T2+T3. As capacitor 124 discharges, the potential on the base of transistor 116 rises. When transistor 116 turns on, it turns on transistors 310 and 362. Transistor 362 clamps the base of Darlington pair 110 to ground through diode 364; and Darlington pair 110 is turned off, terminating the (ignition) interval T2+T3.

As previously noted, the discharge interval for capacitor 124, (T2+T3), is subdivided into a pilot ignition interval T2 and a pilot stabilization interval T3. Intervals T2 is determined by the time constant for charging and discharging capacitor 203. When capacitor 203 charges through resistor 201, diode 368, and relay coil 36 to the point where transistors 207 and 213 conduct, relay coil 34 is energized thereby interrupting ignition by opening contacts 34-2 and de-energizing the spark device 20. After the ignition has been turned off at the end of T2, the remainder of the interval T2+T3 provides the pilot stabilization period T3 which is terminated by the discharge of capacitor 124 as hereinbefore described. With this arrangement, a stable pilot flame is established before the main fuel valve is turned on to initiate the main flame in the fire box. Similarly, at the end of pilot stabilization interval T3, a main fuel ignition interval T4 is established with the time interval determined by the discharge time for capacitor 203 which starts to discharge at the end of T3 thus corresponding to the start of interval T4. At the end of interval T4 when capacitor 203 has discharged, with main flame occurrence and maintenance having been established, the pilot flame is turned off by relay 34 dropping out corresponding to the end of main fuel ignition interval T4. Thus the operation and function of the system is modified and augmented by the intervals established by the charge and discharge circuits for capacitor 203 to supplement the intervals established by the charge and discharge of capacitor 124.

The timing of the intervals T2 and T4 under the control of the charge and discharge of capacitor 203 will now be described. After the purge period T1 the charge level of capacitor 124 is such that it turns off transistor 116 turning off transistors 251, 360, and 362. When transistor 362 turns off, the clamp via diode 364 is removed from the base of Darlington pair 110, turning on Darlington pair 110. The current through Darlington pair 110 energizes relay 32 which starts the pilot fuel supply 18 by closing contacts 32-1. When Darlington pair 110 is on, transistor 370 is off and the potential on ignition request line 330 is applied across resistors 365 and 201 to start charging capacitor 203, thereby timing the pilot ignition interval T2. When the capacitor 203 has charged to a bias level determined by resistors 209 and 211, which bias transistor 207, the transistor 207 is turned on turning on transistor 213 to energize relay coil 34. This charge level for capacitor 203 establishes the end of interval T2 and the energization of coil 34 closes contacts 34-1 and opens contacts 34-2 to respectively de-energize the ignition device 20 and establishing another path for maintaining pilot fuel device 18 on. As capacitor 124 continues to discharge, it times out the end of interval T3 which turns on transistor 116 which turns on transistor 360 and 362 connecting one side of relay coil 36 to ground. If a flame has been detected, flame signal line 108 is held at a positive DC potential by transistor 104; and current flows from flame line 108 through relay coil 36 and transistors 360 and 362 to ground. Current through relay coil 36 actuates its contacts to close contacts 36-2 to supply the main fuel to the burner and opens contacts 36-1 to interrupt the intitial circuit for energizing pilot fuel supply 18 which, however, remains energized by the closed contacts 34-1. When transistor 116 is turned on at the start of T4, Darlington pair 110 is turned off by transistor 362 and the RC circuit of resistor 201 and capacitor 203 starts to discharge. The discharge period for capacitor 203 to reach its initial level where the bias on transistor 207 will switch transistor 207 off corresponds to the time interval T4 during which the main flame ignition is established. At the end of interval T4 transistors 207 and 213 are turned off thereby de-energizing relay coil 34 and terminating the pilot flame by de-energizing pilot control 18. Relays 36 and 32 remain energized due to the alternate energizing current path through transistor 362. As long as the main fuel flame is detected by signals at terminals 200, 202 which result in a flame presence signal on line 108, the system continues operation with the main fuel supply controlled by energizing main fuel control 22 through the closed contacts 36-2, 32-1 and the normally closed alarm relay contacts 30-2.

Upon failure of the main flame and detection thereof by absence of main flame signal at terminals 200, 202 the low signals resulting therefrom on line 108 immediately switches off transistor 250 thereby interrupting current flow to relay coil 32. With line 108 low, current no longer flows through relay coil 36 which opens contacts 32-1 and 36-2 and cuts off all power including termination of main fuel flow by de-energizing main fuel control 22. The time for main fuel cut-off is indicated as interval T5 and generally is not more than four seconds maximum to meet U.S. requirements and one second maximum for European standards. This time is determined primarily by the RC circuit to resistor 212 and capacitor 213. A time constant circuit established by resistor 212 and capacitor 213 controls T5 to prevent initiation of main fuel cutoff for momentary flicker by eliminating the corresponding fluctuations in the flame presence signal applied to transistor 94. During normal main flame operation the system monitors the established flame until the operation request switch 26 opens, terminating the burner cycle.

If no flame signal voltage has been applied to bus 108, when Darlington pair 110 is turned off, control relay actuator 32 is de-energized, opening contacts 32-1 and terminating ignition and fuel flow. The base voltage to transistor 172 is also removed so that transistor ceases conduction (removing the clamp on Darlington pair 114) and an alternate lockout path is established as Darlington 114 is triggered into conduction through conducting transistor 146. Lockout actuator 30 thus continues to heat and at the end of its time delay, it opens normally closed contacts 30-2, shutting down the burner system, and closes normally open contacts 30-1, energizing alarm 14.

A latch circuit 377 is connected between the base of Darlington 114 and the air flow signal line 58. During normal operation, ignition request line 330 goes high before power is applied to air flow line 58, and a reset circuit made up of capacitor 379, resistor 381, and diode 383 keep the potential across the base-emitter junction of transistor 378 at approximately zero volts, as power is applied, inhibiting conduction of transistor 378 and maintaining latch 377 in the off state. If air flow switch is by-passed or stuck in the on position, air flow line 58 goes high before ignition request line 330 and latch 377 turns on. This applies current to the base of Darlington 114, heating lockout relay 30 until it trips. Thus, in response to a closure of air flow switch 38 before operating control 26 is closed, the system goes to lockout.

Should a spurious flame signal appear during the pre-ignition timing interval (prior to the switching of Darlington pair 110 into conduction), the voltage on flame signal bus 108 goes high, and the emitter of transistor 250 also goes high. The high signal at the emitter of transistor 250 is applied via resistor 376 to the base terminal of transistor 380, turning on latch 377, which remains on even after removal of the spurious flame signal. Current from latch circuit 377 turns on Darlington 114 and heats lockout relay 30 until it trips. Thus, in response to a spurious flame occurring any time during pre-ignition, the system goes to lockout. After ignition, transistors 170 and 172 are on, and the high flame signal at the emitter of transistor 250 is bypassed to ground through resistor 376 and transistor 172.

The charging circuit for capacitor 124 includes a reset discharge transistor 302 which has its collector-emitter path connected via diodes 400 and 402 and resistor 404 across capacitor 124. The base of transistor 302 is coupled to ground through a diode 303 and resistor 406. As long as air flow signal line 58 is high, node 408 is held high by diode 410. If the air flow signal line goes low, the base of transistor 302 is pulled low by diode 303 and resistor 406; and transistor 302 turns on, discharging capacitor 124. During normal pre-ignition, air flow switch 26 remains closed and transistor 302 stays off. If the air flow switch opens, transistor 302 discharges capacitor 124 and restarts the purge period. While transistor 302 is on, current from ignition request line 330 is applied via transistor 302, diodes 400 and 128 and resistors 404 and 130 to the base of Darlington 110. If the air flow line 58 does not return high before the lockout period, lockout relay 30 trips and the system locks out.

If the air flow switch opens during main burner firing, line 58 goes low and the signal at the emitter of transistor 250 goes low, as in a flame failure. The system then proceeds as in a flame failure, going to lockout.

Should the plug in card on which capacitor 124, diode 154 and resistor 158 are mounted be omitted, the circuit will lock out in response to a request for burner operation. Ground potential is applied to the base of transistor 138 through resistor 130, coil 36, diode 368 and transistor 362, and thus transistor 138 turns on, turning on transistor 146. Darlington pair 114 is triggered into conduction by conduction of transistor 146 while Darlington pair 110 is held non-conducting as diode 54 is not in circuit. Lockout actuator 30, at the end of its time delay, opens contacts 30-2, shutting down the burner system, and closes contacts 30-1 energizing alarm 14.

DC power is always applied to line 52, and should the flame sensor connected at terminals 200, 202 indicate the presence of flame in the combustion chamber when operating switch 26 is open, the flame signal causes conduction of transistor 104 which applies a signal through lines 108 and 254 and resistor 390 to raise the potential on the control electrode of Darlington pair 114 and turn on that switch, completing an energizing path for the lockout actuator 30 through resistors 112 and 223, and Darlington pair 114 to ground bus 60. Thus lockout actuator 30 is energized even though there is no request for burner operation and if the spurious flame condition persists, the burner system will lockout, opening contacts 30-2 (preventing operation of the burner system) and closing contacts 30-1 (energizing alarm 14). The burner control electronics do not respond and neither relay 32 nor 36 is energized as there is no power on bus 58 during off heat intervals.

FIGS. 4–8 show the operation of the burner control circuit in the presence of several different malfunctions.

Figure 4:
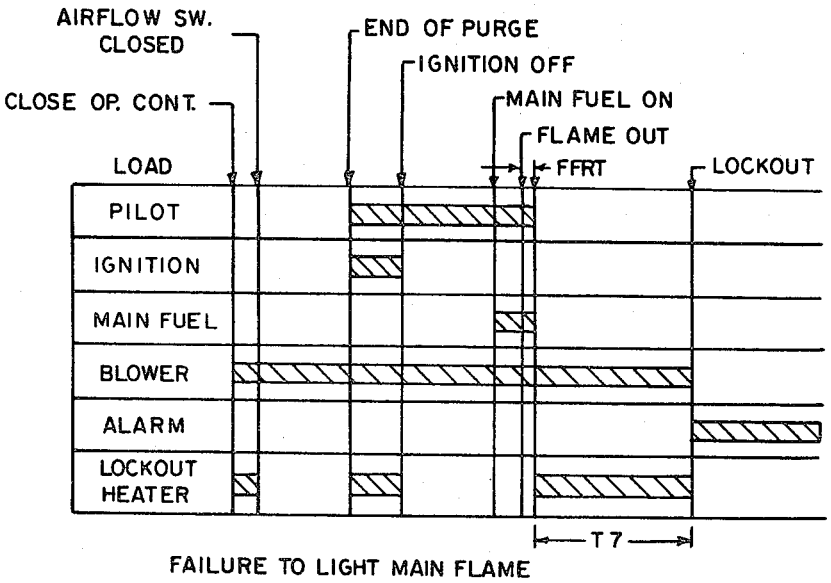

FIG. 4 shows the sequence of burner which fails to light the main flame and shows how the burner goes through a normal startup procedure proving the pilot and then showing a flame-out shortly after the main fuel is turned on. Following a flame-out the fuel is shut off within the flame failure response time and the blower continues operating until the lockout switch trips. This provides post-purge time T7.

Figure 5:
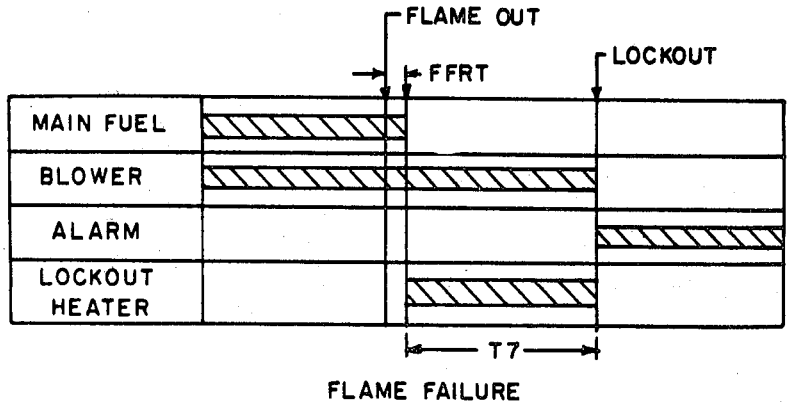

FIG. 5 shows the operating sequence for normal burner operation during startup but with the condition that the flame fails during the firing cycle. After the expiration of the flame failure response time, the fuel is shut off. The blower continues operating for the post-purge period T7.

Figure 6:
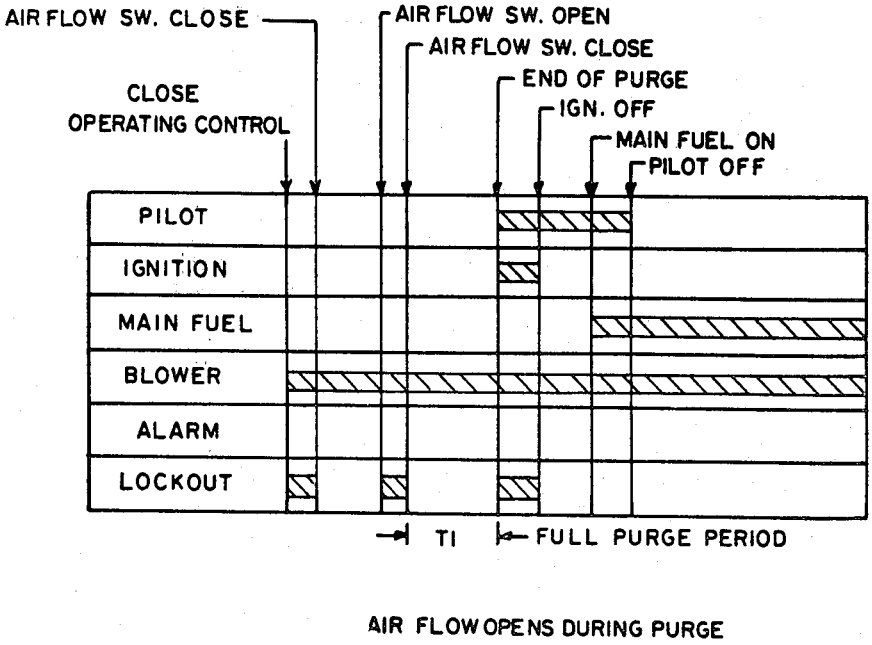

FIG. 6 shows the operating sequence for the condition where the air flow switch opens during the purge period. As shown in the diagram of purge timing starts when the air flow switch first closes but stops when the air flow switch opens. Immediately thereafter the purge timing is reset to zero. When the air flow switch again closes, the purge timing starts again but requires a new complete purge time interval. Then a normal burner startup continues. Whenever the air flow switch is open during the purge, the lockout switch will be heated, and if this continues long enough the lockout will lock out and turn off the blower motor.

Figure 7:
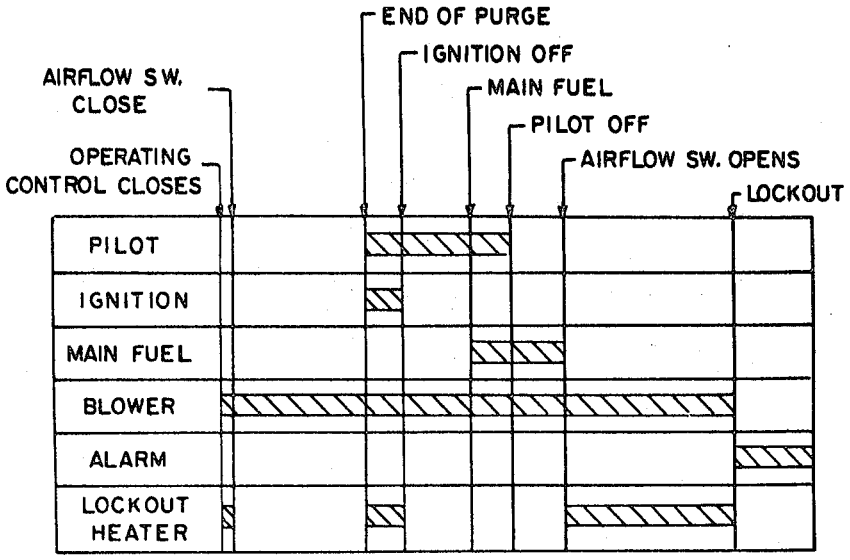

FIG. 7 shows the sequence of burner operation for the fault condition of the air flow switch opening during the firing cycle. As soon as the air flow switch opens, the fuel valve is de-energized and the lockout switch heater is energized until the lockout switch operates.

Figure 8:
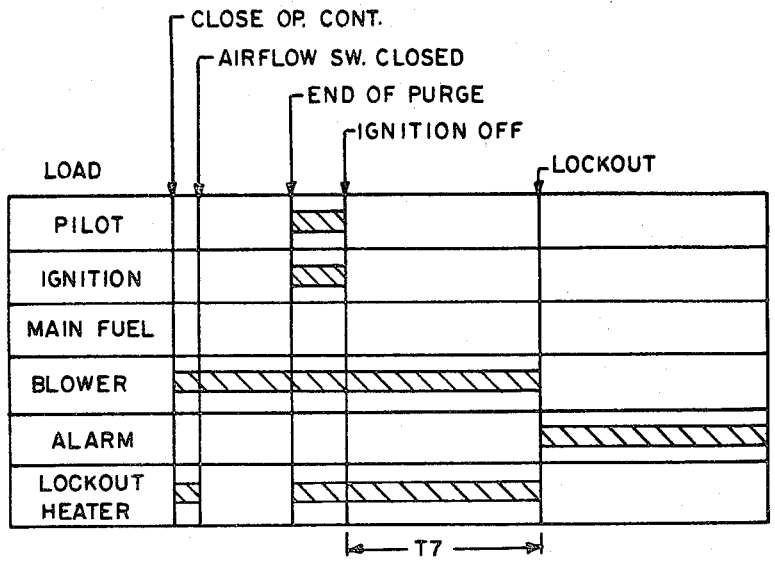

FIG. 8 shows the sequence of a burner that fails to ignite the pilot and shows that the fuel and ignition are removed at the termination of the normal trial period for ignition of pilot. The blower continues operating until the lockout switch trips (post-purge time T7).

To briefly summarize the operation of the present invention, the flame sensing and lockout circuits are continuously energized through DC power line 52, independent of a call for heat or the state of air flow switch 38. In response to a call for heat and consequent operation of blower 16 while switch 38 is opened followed by sufficient air flow to close switch 38, transistors 352 and 338 are triggered into conduction to apply power to lines 58 and 330, energizing the timing circuitry to commence the timing of sequential intervals controlled by the charging and discharging of capacitor 124. Capacitor 124, diode 154 and resistor 158 are mounted on a plug in unit and thus enable ready change of the timing of either or both intervals. A first (pre-ignition) time interval is controlled as a function of the RC values in the capacitor charging circuit and at the end of that interval transistors 138 and 146 are triggered into conduction. That action latches both transistors 138 and 146 and connects the plus side of capacitor 124 to resistor 122, abruptly dropping the voltage applied to diode 160. This voltage transistor turns off transistor 116 and Darlington pair 110 is switched into conduction producing current flow through lockout actuator 30, resistor 222, Darlington pair 110, bus 178, control relay coil 32 and resistor 100. Thus at the initiation of the second (ignition) interval heating of the lockout actuator 30 commences and simultaneously relay 32 is pulled in, initiating an ignition condition by energizing pilot fuel control 18 and spark transformer control 20. Conduction of transistor 146 also turns off transistor 170 and the voltage on bus 178 supplied to the base of transistor 172 through resistor 176 turns on clamp transistor 172, clamping the control electrode of Darlington pair 114 to the ground bus 60 through diode 174 and preventing turn on of Darlington pair 114. This alternate lockout actuator energizing path remains disabled as long as the transistors 138, 146 are latched in conducting condition and there is voltage on bus 178.

As capacitor 124 discharges, the potential at the base of transistor 116 rises. After a time interval determined essentially by the value of capacitor 124 and resistor 158, transistor 116 is turned on again, turning off Darlington pair 110 and terminating the second (ignition) time interval and, if an alternate control relay energizing path (through transistor 68) has not been established, de-energizing control relay actuator 32. When power is removed from bus 178 clamp transistor 172 is released so that the voltage at the control electrode of Darlington pair 114 rises (transistor 146 being turned on), turning on that switch 114 and continuing the heating of lockout actuator 30 through the alternate energizing path until the end of its time delay when it opens normally closed contacts 30-2, shutting down the burner system, and closes normally opens contacts 30-1, energizing alarm 14.

This lockout sequence is interrupted by appearance of flame signal pulses at terminals 200, 202 which via transistor 94 switches on transistor 104 and after time delay determined in part by capacitor 220 also switches on transistor 250. The emitter of transistor switch 250 is connected to relay coil 32, and application of power to bus 108 completes an alternate relay actuator maintaining circuit through actuators 36 and 32.

Flame failure will cause transistors 104 and 250 to cease conduction, the resulting absence of voltage on bus 178 will relese the clamp on the control terminal of Darlington pair 114 and the alternate lockout energizing circuit will be switched into conduction because of latched transistor 146. In the present embodiment the system will lockout without recycle on flame failure, although other burner control systems may recycle through the ignition sequence. One such embodiment which may be used with the present invention is shown in the above-referenced patent application.

Figure 9:
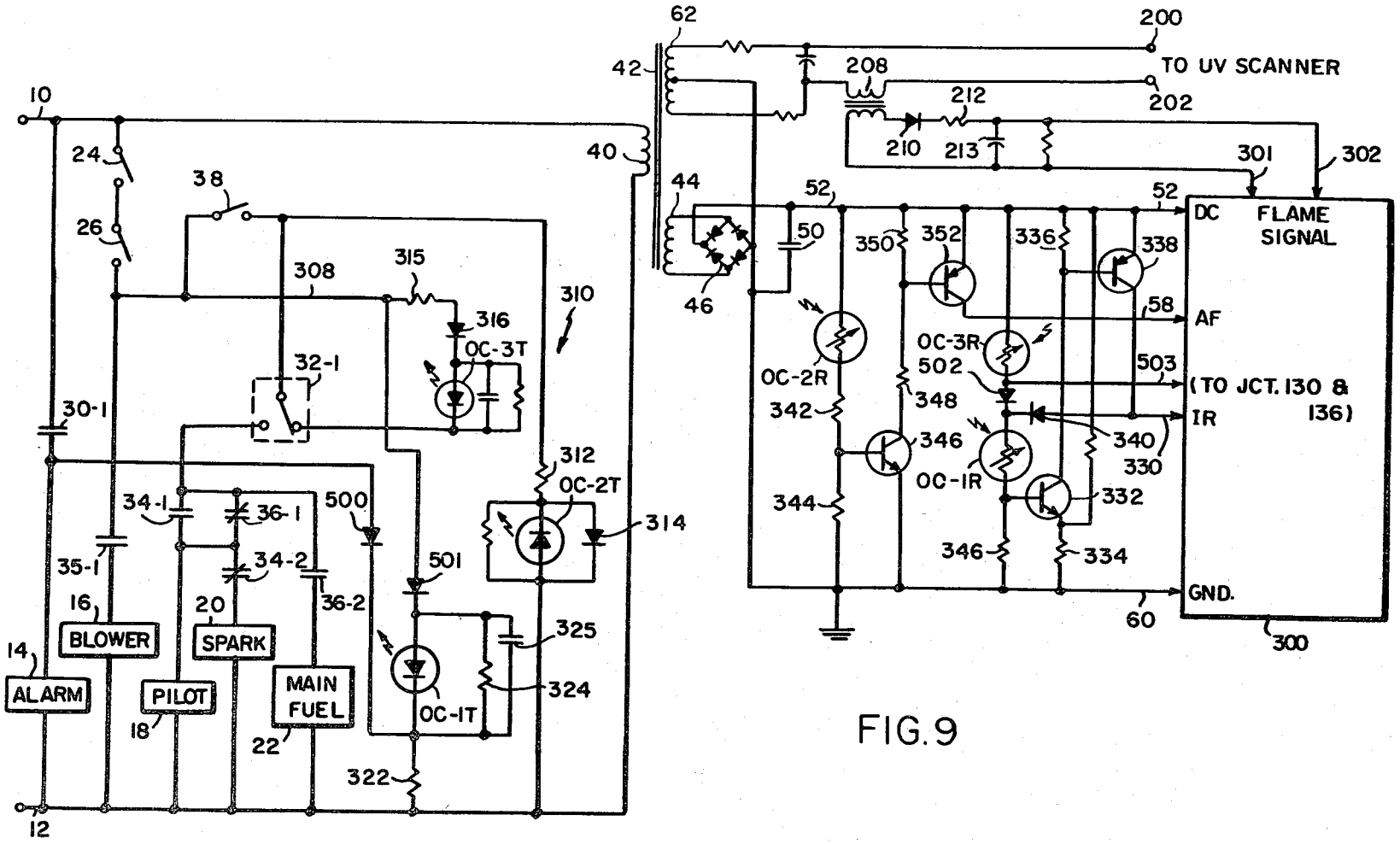
FIG. 9 shows an alternate embodiment of the invention.

Referring to FIG. 9, there is shown an alternate embodiment of that part of the burner control system shown in FIG. 1 which provides additional safeguards and self-checking features. Those portions of FIG. 9 which are identical to FIG. 1 are not discussed hereinbelow except to the extent that their operation is affected by the circuit modification incorporated in FIG. 9.

As before, the A.C. power line signal from terminals 10 and 12 is continuously applied to primary winding 40 of transformer 42. The A.C. power is applied to the A.C. control circuitry section through limit switch 24. Operating control 26, typically a thermostat, has been moved so that power from terminal 10 applied directly to alarm device 14 through lockout switch contacts 30-1. This allows the alarm to continue to provide an alarm signal even after operating switch 26 opens. Operating switch 26 is connected in series with limit switch 24, blower motor 16, and normally open contacts 35-1 of a blower relay 35, described in more detail below.

The pilot and main fuel controls 18 and 22 and ignition device 20 are connected to A.C. power through operating control 26 air flow switch 38, and single-pole double-throw relay contacts 32-1. Putting air flow switch 38 in series with these loads provides further protection against circuit malfunctions. Thus, the pilot and main fuel valve 18 and 22 and the ignition device 20 are not powered until air flow switch 38 closes and relay 32 is actuated at the end of the purge interval, as described above. Once relay 32 has been actuated and switch contacts 32-1 change state, the pilot and main fuel valve and the ignition device are controlled by relays 34 and 36.

Optical coupler OC-3 checks the operation of air flow switch 38 at the beginning of the purge interval in the following manner. During the purge interval, relay contacts 32-1 are in the state shown in FIG. 9 so that optical coupler transmitter OC-3T, isolation diode 316, and current limiting resistor 315 are connected in series across the contacts of air flow switch 38. If air flow switch 38 is open at the beginning of the purge interval, the transmitter of optical coupler OC-3 is illuminated. If air flow switch 38 is shorted or jammed in a closed position, the voltage across the transmitter OC-3T is shunted by the closed contacts of air flow switch 38, and optical coupler OC-3 does not turn on. At the end of the purge interval, optical coupler OC-3 is disconnected from the circuit by relay contacts 32-1 when relay 32 is activated to begin the pilot interval.

Optical coupler OC-2 provides a signal indicating when air flow switch 38 is closed. Optical coupler transmitter OC-2T is connected in series with current limiting resistor 312 between air flow switch 38 and terminal 12. When air flow switch 38 closes, power is applied to optical coupler OC-2T through resistor 312 turning on the optical coupler circuit. Diode 314 is connected in parallel with the light emitting diode transmitter of optical coupler OC-2T with the opposite polarity thereto. Diode 314 prevents breakdown of the optical coupler diode and provided a path for current flowing through optical coupler OC-3T when air flow switch 38 is closed.

Optical coupler OC-1 provides a signal indicating when operating control 26 is closed applying power to bus 308. The light source of optical coupler OC-1 is connected between bus 308 and terminal 12 in series with diode 501 and current limiting resistor 322. Resistor 324 and capacitor 325 are connected in parallel with light source OC-1T and serve to provide protection against high voltage spikes and leakage for the light emitting diode. When power is applied to bus 308, current flows through the optical coupler transmitter OC-1T turning on optical coupler OC-1.

The normally-unpowered terminal of lockout relay contacts 30-1 is connected to the junction of OC-1T and resistor 322 via a diode 500. If a lockout occurs, contacts 30-1 close and current flows through diode 500 pulling the junction of OC-1T and resistor 322 high. The voltage drop across diode 500 is matched by the voltage drop across diode 501 connected in series with OC-1T so that there is no voltage drop across OC-1T. Thus, when a lockout occurs, optical coupler OC-1 immediately turns off. This removes power from IR line 330, deactivating blower relay 35 and turning off the blower. This causes air flow switch 38 to open, turning off optical coupler OC-2 which removes power from AF bus 58.

In the D.C. powered section of the control electronics shown in FIG. 9, a diode 502 has been added in series with receiver OC-3R and receiver OC-1R. The junction of receiver OC-3R and diode 502 is connected via line 503 to the junction of purge interval timing resistor 130 and diode 136 of burner control electronics 300, shown in FIG. 2. This circuitry prevents a dangerous condition from developing in case of a failure such as a short of OC-2. If OC-2 shorts, a voltage is applied on the air flow line AF before air flow switch 38 closes. OC-3 is on, since the air flow switch 38 is not closed. Thus, the voltage on line 503 is high holding the junction of diode 136 and timing resistor 130 high also. This prevents capacitor 124 from charging. As a result, the purge period will continue indefinitely and no fuel will be turned on, if OC-2 is shorted.

The circuitry shown in FIG. 9 requires the addition of a blower relay 35 and associated circuitry to the control electronics 300 shown in FIG. 2. The additional circuitry necessary is shown in FIG. 2 within dotted box 504. One terminal of blower relay 35 is connected to air flow bus 58. The second terminal of the coil of blower relay 35 is connected by a diode 506 to the junction of lockout relay 30 and resistor 222, and is also connected to ground through a resistor 508. A diode 510 is connected across blower relay 35 as shown to shunt the reverse current caused by the relay coil self-inductance when blower relay 35 is deactivated.

Blower relay 35 operates in the following manner. To begin operation, operating control 26 closes applying power to ignition request bus 330. Current then flows through lockout actuator 30 until air flow switch 38 closes, as shown in FIG. 4 and described above. The coil of blower relay 35 is connected by diode 506 across the supply voltage on ignition request bus 330 and a low voltage at the bottom side of lockout actuator 30. This causes the blower relay 35 to pull in, closing contacts 35-1 in series with blower motor 16 and turning on the blower motor. Shortly thereafter, air flow switch 38 closes, and power is removed from lockout actuator 30. Blower relay 35 is maintained in an activated condition after the removal of lockout power by resistor 508. The value of resistor 508 is such that it is sufficient to hold blower relay 35 on once it has been activated, but does not provide enough current initially to activate the blower relay.

If air flow switch 38 is shorted or jumpered, OC-3 will not turn on. This prevents power from being applied to ignition request line 330 and thus prevents blower relay 35 from being turned on. Thus, if air flow switch 38 is shorted, blower relay 35 remains off, no power is applied to blower motor 16 and the system will lockout.

The blower relay circuitry also verifies proper operation of the lockout heating circuitry and prevents the blower motor from turning if this circuitry is not functioning. If blower motor 16 does not turn on, the system will remain in a pre-purge state, even if the lockout activating circuitry is malfunctioning, and thus the burner control electronics will not initiate an ignition cycle.

The use of blower relay 35 in conjunction with SPDT contacts for relay contacts 32-1 allows the proper operation of relay 32 to be verified and guards against welded contacts. If relay 32 is stuck in the "on" state (i.e. opposite to that shown in FIG. 9) OC-3T is no longer connected across air flow switch 38 and does not turn, preventing power from being applied to ignition request bus 330. In such a case, when operating control 26 is closed, blower relay 35 is not activated and the system will remain in a pre-purge state until lockout occurs.

There has been described a new and improved burner control system which has advantages over those previously known. It should be appreciated that modifications will be made by others to the preferred embodiment described herein in applying the teachings of the present application. Accordingly, the present invention is not to be limited by the disclosure of the specific circuit described above, but rather the present invention should only be interpreted in accordance with the appended claims.

What is claimed is:

1. Burner control apparatus for use with a fuel burner installation having an operating control switch which is actuated to produce an ignition request signal, an air flow switch which provides an air flow signal to indicate the presence of an adequate air flow through the burner, and means responsive to said burner control apparatus for controlling fuel flow, said burner control apparatus comprising:

an electronic timing circuit for providing an ignition cycle having successive timing intervals including in sequence a purge interval, a pilot ignition interval, a pilot stabilization interval and a main fuel ignition interval;

air means for providing an air flow through the burner during said ignition cycle;

lockout means, responsive to a lockout signal applied thereto for a predetermined time, for terminating burner operation and stopping fuel flow to said burner installation;

means, responsive to said operating control switch, for activating said timing circuit, including:

a first photocoupler having a light source connected in parallel with said air flow switch and providing an output signal across its output terminals when said air flow switch is open;

a second photocoupler having a light source connected in series with said air flow switch and providing an output signal across its output terminals when said air flow switch is closed;

means, operative in response to an ignition request signal, for initially applying power to the timing circuit to begin an ignition cycle only if said first photocoupler output signal is present; and means, operative in response to an ignition request signal, for applying a lockout signal to said lockout means until the occurrence of said second photocoupler output signal;

whereby said timing circuit is disabled to prevent further ignition cycle operation if said air flow switch is closed before said air means is operative and said lockout means is actuated to prevent further ignition cycle operation if said air flow signal is not present within a predetermined time after said air means is operative.

2. The apparatus of claim 1 wherein said air means includes a blower relay for applying power to a blower; and wherein the control apparatus further includes means for actuating said blower relay in response to the presence of a lockout signal and for maintaining said blower relay in an actuated condition thereafter.

3. The apparatus of claims 1 or 2 wherein said means for initially applying includes:

a third photocoupler having a light source connected in series with said operating control switch, and having output terminals connected in series with the output terminals of said first photocoupler;

power circuit means, responsive to a signal applied to a control terminal, for providing power on an output terminal to said timing circuit; and means for applying power through the series-connected output terminals of said first and third photocouplers to the control terminal of said power circuit means so that power is applied to said timing circuit in response to an ignition request signal only when said air flow switch is initially open.

4. The apparatus of claim 3 wherein one output terminal of said third photocoupler is connected to said power circuit means control terminal and the second output terminal of said third photocoupler is connected to said power circuit means output terminal by a diode having a polarity such that a signal is applied to said power circuit means control terminal through said diode and third photocoupler after said air flow switch closes.

5. The apparatus of claim 4 wherein the timing circuit includes a capacitor which is discharged to time said purge interval;

and further including means connected to said capacitor and responsive to said first photocoupler output signal for preventing said capacitor from discharging until said air flow switch closes and removes said first photocoupler output signal.

* * * * *